US006257762B1

(12) United States Patent
Guzik

(10) Patent No.: US 6,257,762 B1
(45) **Date of Patent: *Jul. 10, 2001**

(54) LEAD SURFACE COATING FOR AN X-RAY TUBE CASING

(75) Inventor: Jadwiga B. Guzik, Dousman, WI (US)

(73) Assignee: General Electric Company, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/253,337

(22) Filed: Feb. 19, 1999

(51) Int. Cl.[7] ..... H01J 35/16

(52) U.S. Cl. ..... 378/203; 378/200; 378/202; 205/131

(58) Field of Search ..... 378/130, 140, 378/141, 199, 200, 201, 202, 203; 205/80, 118, 131, 151

(56) References Cited

U.S. PATENT DOCUMENTS

| | | | | |
|---|---|---|---|---|
| 2,164,997 | * | 4/1939 | Machlett | 378/200 |
| 3,859,534 | * | 1/1975 | Loughlin | 378/203 |
| 4,964,148 | * | 10/1990 | Klostermann et al. | 378/127 |
| 6,062,731 | * | 5/2000 | Guzik | 378/203 |

* cited by examiner

*Primary Examiner*—David P. Porta
*Assistant Examiner*—Drew A. Dunn
(74) *Attorney, Agent, or Firm*—Barbara Joan Haushalter; Christian G. Cabou; Phyllis Y. Price

(57) ABSTRACT

An x-ray tube casing coating prevents lead contamination of oil. The aluminum casing housing an x-ray tube has a lead lining with a top surface and a bottom surface, and is exposed to a dielectric cooling oil. An electroplating material is applied to both the top and bottom surfaces of the lead lining, forming an electroplated layer between the lead lining and the casing to prevent lead contamination of the dielectric cooling oil.

14 Claims, 2 Drawing Sheets

LEAD SURFACE COATING FOR AN X-RAY TUBE CASING

BACKGROUND OF THE INVENTION

This invention relates to x-ray tube casings and particularly to an x-ray tube casing coating for preventing lead contamination of oil.

The casings of x-ray tubes are lined with lead to prevent the leakage of x-rays in directions other than through the window of the tube. This lead is exposed to a dielectric cooling oil which removes heat from the tube insert during operation. X-ray exposure causes a gradual breakdown in the oil forming smaller and less saturated compounds. The lead readily oxidizes and a combination of this oxide and particles on the lead surface make coating the lead necessary to prevent oil contamination.

Currently, various epoxy type paints are used to coat tube casings and prevent leakage of the x-rays. Unfortunately, the lead which lines the casings of x-ray tubes provides a poor surface for adherence. Hence, the hot oil, x-rays and chemicals generated during the x-ray exposure of the oil all gradually promote flaking of the paint from the surface. Furthermore, the enamel and epoxy paints currently used to coat tube casings are susceptible to peeling and scratching during assembly. The particles created by the flaking, peeling and scratching cause tube instability and tube failure. In addition, the casings often require manual touch-up of the paint, and paint damaged during handling and assembly creates rework requirements as well. All of these problems impact casing quality and availability and increase the casing cost.

It is seen, then, that it would be desirable to have a more adherent, durable and long-lasting coating for x-ray tube casings which can overcome the problems of prior art tube casing coatings.

BRIEF SUMMARY OF THE INVENTION

The present invention provides for electroplating of lead sheet linings for x-ray tube casings, as a replacement for the paint coatings currently used in the art. The present invention further addresses the formation and installation of such lead sheet linings, which, if used on prior art structures, would cause peeling of a painted surface.

An adherent and durable coating is provided for a lead-lined x-ray tube casing which is exposed to dielectric cooling oil. Electroplating lead radiation shield material with a corrosion resistant and nontoxic lining material having excellent solderability, softness and ductility, provides a clean corrosion resistant surface which is inert to the oil, independent of temperature and x-ray irradiation. The electroplated lead sheet lining material preserves the lead surface from flaking and corroding to the oil. The use of electroplated lead allows for lead sheet which can be formed by blanking, drawing, rubber forming, rubber punching and hammering, without peeling of the electroplated coating. The lead sheet is electroplated on both sides, and then a surface of the electroplating layer is attached, such as by epoxy, to the aluminum casing.

Accordingly, the present invention provides a lead sheet lining which has been electroplated on both sides, for attachment to x-ray tube casings, thereby providing a more adherent and durable, and longer-lasting x-ray tube casing coating.

DETAILED DESCRIPTION OF THE INVENTION

Figure 1:
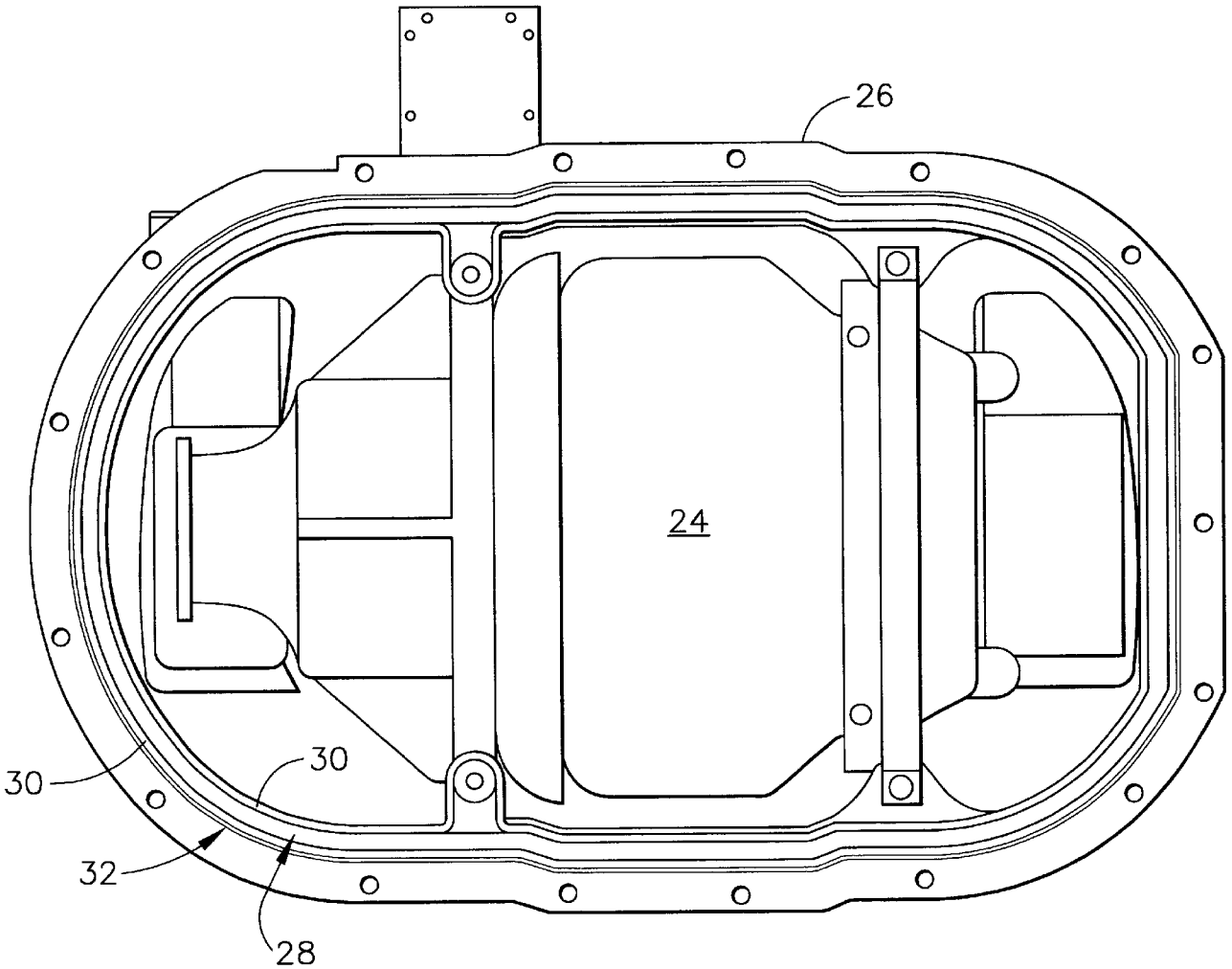
FIG. 1 is a representative x-ray tube structure illustrating a coated lead surface for an x-ray tube casing.

The present invention relates to rotating x-ray tubes, and particularly to x-ray tube casings. In a typical assembly, the lead surface of the x-ray tube casing is coated with a paint layer. Referring to FIG. 1, a representative illustration of an x-ray tube casing 26 is shown. The x-ray tube casing 26 encases an x-ray tube structure 24, including an anode assembly for distributing heat generated at a focal spot and a cathode assembly for producing x-rays upon impact with the anode.

In any x-ray tube system, certain of the surfaces are necessarily lead surfaces. When these lead surfaces comprise electroplated lead sheet linings, as indicated by layer 28, there is provided a more adherent and durable lead sheet lining for the tube casing 26. Electroplated lead surfaces 28 are described and claimed in co-pending, commonly assigned patent application Ser. No. 09/139497, now U.S. Pat. No. 6,062,731 totally incorporated herein by reference.

The present invention proposes electroplating both sides of a lead sheet lining for subsequent attachment to x-ray tube casings, which is particularly well suited in structures wherein the purpose of the lead sheet lining is to prevent the leakage of x-rays in directions other than through a window of an x-ray tube. The electroplated lead sheet lining 28 is exposed to dielectric cooling oil which removes heat from the tube insert during operation.

It is known, of course, that the casings of x-ray tubes are lined with lead to prevent the leakage of x-rays in directions other than through the window of the tube. This lead is exposed to dielectric cooling oil which removes heat from the tube insert during operation. X-ray exposure causes a gradual breakdown in the oil, forming smaller and less saturated compounds. The lead readily oxidizes and a combination of this oxide and particles on the lead surface make coating the lead necessary to prevent oil contamination.

Currently, various epoxy type paints have been used for this purpose, but the lead provides a poor surface for adherence and the hot oil, x-rays and chemicals generated during the x-ray exposure of the oil all gradually promote flaking of the paint from the surface. Hence, as disclosed in U.S. patent application Ser. No. 09/139,497, now U.S. Pat. No. 6,062,731 electroplating of the lead is evaluated as a replacement for the paint coatings. The use of electroplated lead, then, allows for electroplated lead sheet. Heretofore, the lead which lines the casings of x-ray tubes has provided a poor surface for adherence. Consequently, the dielectric oil, x-rays and various chemicals generated during each x-ray exposure all gradually promote flaking of the paint from the surface. With the present invention, electroplated lead can be used for forming lead sheet linings of x-ray tube casings, such as is indicated in FIG. 1. It is well known in the art that the lead lining is exposed to a dielectric cooling oil which removes heat from the tube insert during operation. Hence, the lead lining 28 of the present invention prevents lead contamination of the dielectric cooling oil.

The use of electroplated lead will allow for lead sheet which can be formed by blanking, drawing, rubber forming, rubber punching, hammering, and various other suitable methods understood by those skilled in the art, without peeling of the electroplated coating. It will further be obvious to those skilled in the art that various metals can be used to create the coating for electroplating the lead surface, including, for example, silver, copper, nickel or tin, or various combinations of these or other metals.

Figure 2:
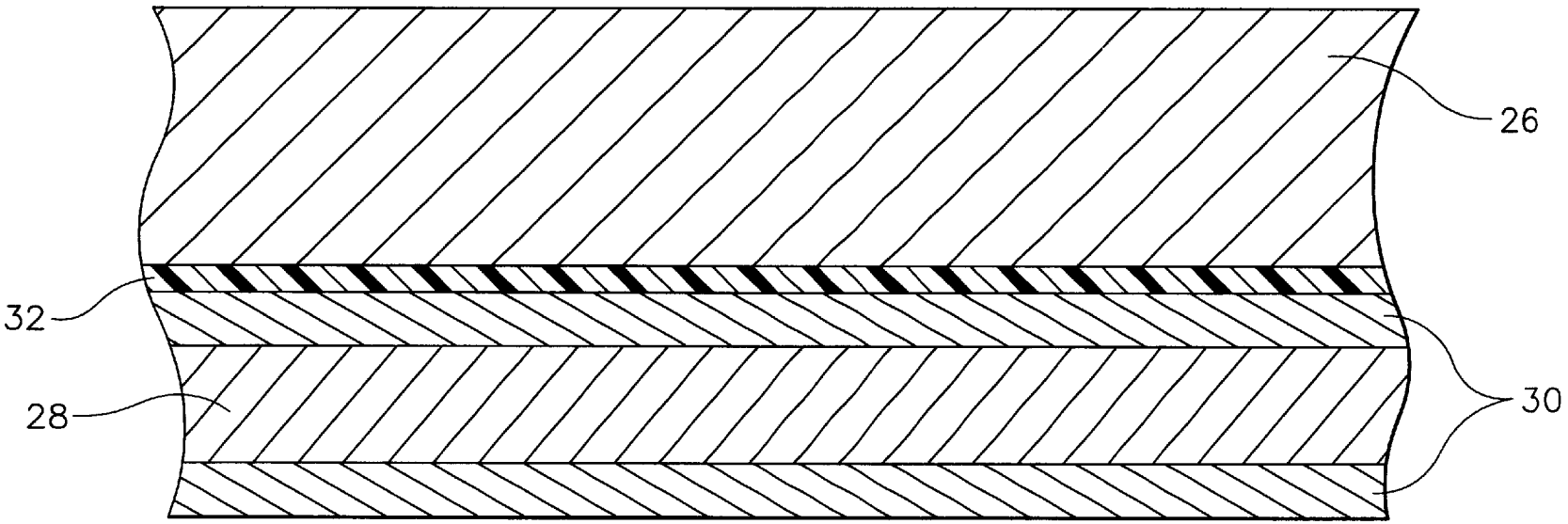
FIG. 2 is an exploded view to illustrate the layers that comprise the coated lead surface and casing of FIG. 1.

Referring now to FIG. 2, in a preferred embodiment of the present invention, the electroplated metal for casing lining layer 28 comprises tin. An electroplated layer 30 is applied to both sides or surfaces of the lead 28, with a preferred thickness of 2 mil, although variation within hundredths, or even tenths of a mil is allowable while still achieving the spirit of the invention. Epoxy 32 or other suitable attachment means are used to attach one side of the electroplated layer, comprising the electroplating material and the lead lining, to the aluminum casing 26. Electrodeposits of tin are corrosion resistant and non-toxic, possess excellent solderability and are noted for softness and ductility.

Electroplating lead radiation shield material with tin provides clean corrosion resistant surfaces which are inert to the oil, independent of temperature and x-ray irradiation. The electroplated layer 30 preserves the lead surface 28 from flaking and corroding to the oil. The higher thermal conductivity of tin versus the paint of the existing art allows a higher rate of heat transfer from the oil to the casing wall and lowers bulk oil temperature. The high ductility of tin allows the electroplated layer to conform to the lead without cracking when the lead is deformed in a radius of 1 cm, and to create a self-healing system, whereby minor scratches repair themselves. The problems of poor adherence, cracking with deformation, and flaking that occurs with paint coatings of the prior art are not present for the lead electroplating method of the present invention.

The ductile lead can be formed to shape after the lead is plated with layers 30. Such forming or shaping would cause increased delamination if performed on painted surfaces of the prior art. Furthermore, having the lead surface electroplated with a metal results in increasing the thermal conductivity from the oil to the casing which is supplied with fins for casing-air heat transfer. This results in a lower oil operating temperature compared to the painted lead lining of the prior art. Electroplating eliminates the environmental and regulatory problems associated with the volatile organic compounds in the paint.

After both surfaces, top and bottom, of lead layer 28 are electroplated, such as with tin layers 30, the resultant lead sheet lining can be installed to fabricate the x-ray tube casing structure. Installation may be by any suitable means, such as by applying a layer of epoxy between the tin electroplated layer 30 and the aluminum casing layer 26.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotating x-ray tube comprising:

an anode assembly for distributing heat generated at a focal spot;

a cathode assembly for producing x-rays upon impact with the anode;

a casing for housing the x-ray tube, the casing having a lead lining, the lead lining having a top surface and a bottom surface, and being exposed to a dielectric cooling oil; and an electroplating material for application to the top and bottom surfaces of the lead lining, forming an electroplated layer between the lead lining and the casing.

2. A rotating x-ray tube as claimed in claim 1 wherein the electroplating material comprises tin.

3. A rotating x-ray tube as claimed in claim 1 wherein the electroplated layer prevents lead contamination of the dielectric cooling oil.

4. A rotating x-ray tube as claimed in claim 1 wherein the electroplating material imparts insulating properties to the lead lining.

5. An x-ray tube casing structure comprising:

a lead lining for preventing unwanted leakage of x-rays, the lead lining having a top surface and a bottom surface, with at least one surface being exposed to a dielectric cooling oil; and an electroplating material for coating the top and bottom surfaces of the lead lining to prevent contamination of the dielectric cooling oil.

6. An x-ray tube casing structure as claimed in claim 5 further comprising an epoxy layer to attach the lead lining and the electroplating material to the casing.

7. An x-ray tube casing structure as claimed in claim 5 wherein the electroplating material is selected from the group consisting of silver, copper, tin, nickel and combinations of silver, copper, tin and nickel.

8. An x-ray tube casing structure as claimed in claim 6 wherein the electroplating material comprises tin.

9. An x-ray tube casing structure as claimed in claim 5 wherein the electroplating material has a thickness of approximately 2.0 mil.

10. A method for providing an adherent and durable coating for an x-ray tube casing comprising the steps of:

lining surfaces of the x-ray tube with lead;

exposing the lead lined surfaces to a dielectric cooling oil; and coating the lead lined surfaces with an electroplating material.

11. A method as claimed in claim 10 wherein the electroplating material is applied to all surfaces of the lead lining.

12. A method as claimed in claim 10 wherein the electroplating material comprises a corrosion resistant material.

13. A method as claimed in claim 10 wherein the electroplating material comprises a nontoxic material.

14. A method as claimed in claim 10 wherein the electroplating material comprises a ductile material.

* * * * *